US005145595A

United States Patent [19]

Morris et al.

[11] Patent Number: 5,145,595

[45] Date of Patent: Sep. 8, 1992

[54] ANTI-STATIC FABRIC SOFTENING ARTICLE FOR USE IN AN AUTOMATIC CLOTHES DRYER

[75] Inventors: Patricia A. Morris; Donald L. Wharry; John R. Roheim, all of Austin, Tex.

[73] Assignee: Vista Chemical Company, Austin, Tex.

[21] Appl. No.: 592,280

[22] Filed: Oct. 3, 1990

[51] Int. Cl.[5] ..... C11D 17/06; C11D 17/00

[52] U.S. Cl. ..... 252/91; 252/90; 252/174.21; 252/174.17; 252/8.9; 252/174.25

[58] Field of Search ..... 252/92, 8.9, 174.21, 252/90, 91, 174.17, 174.25

[56] References Cited

U.S. PATENT DOCUMENTS

| | | | |
|---|---|---|---|
| 4,000,340 | 12/1976 | Murphy et al. | 252/8.9 |
| 4,134,838 | 1/1979 | Hooper et al. | 252/8.8 |
| 4,203,851 | 5/1980 | Ramachandran | 252/8.8 |
| 4,209,549 | 6/1980 | Murphy et al. | 252/8.6 |
| 4,514,444 | 4/1985 | Ives et al. | 252/8.8 |
| 4,615,814 | 10/1986 | Winetzky | 252/8.6 |
| 4,720,351 | 1/1988 | Flynn et al. | 252/90 |
| 4,861,502 | 8/1989 | Caswell | 252/8.75 |
| 4,876,023 | 10/1989 | Dickenson et al. | 252/90 |
| 4,913,828 | 4/1990 | Caswell | 252/8.8 |

*Primary Examiner*—Paul Lieberman
*Assistant Examiner*—Bradley A. Swope
*Attorney, Agent, or Firm*—Browning, Bushman, Anderson, Brookhart

[57] ABSTRACT

An anti-static softening composition for use in automatic clothes dryers comprising an ethoxylated alcohol, a fatty alcohol and a stabilizer which is a particulate solid and prevents any substantial release of the ethoxylated alcohol/fatty alcohol mixture at a temperature of up to about 45° C. from a substrate which carries the mixture of the ethoxylated alcohol/fatty alcohol.

8 Claims, No Drawings

ANTI-STATIC FABRIC SOFTENING ARTICLE FOR USE IN AN AUTOMATIC CLOTHES DRYER

BACKGROUND OF THE INVENTION

1. Field of the Invention

The present invention relates to compositions and articles of manufacture for providing anti-static and softening benefits to fabrics in an automatic clothes dryer. More specifically, the present invention relates to anti-static and softening compositions and articles made therefrom which exhibit excellent storage stability.

2. Description of the Background

Numerous compositions have been proposed for incorporation into so called "fabric softeners" used in automatic clothes dryers. Typically, softening agents and anti-static agents are dispensed into the dryer from a suitable substrate on which the anti-static/softening compositions are carried. For example, a highly preferred substrate for use in dispensing the anti-static/softening compositions comprises a sheet of a flexible paper or woven or non-woven cloth on which the compositions have been deposited or impregnated.

Fabric "softening" is generally understood to be that quality of the treated fabric whereby its handle or texture is smooth, pliable and fluffy to the touch. Along with imparting softness, it is desirable that the softener-/anti-static composition reduce the "static cling" of the treated fabrics. Static cling is the phenomenon of one fabric adhering to another or to parts of itself as a result of static electrical charges located on the surface of the fabric. It can also involve the adherence of lint, dust and other similarly undesired substances to fabric due to these static charges. Static cling is noticeably present in fabrics which are freshly washed and then dried in an automatic dryer. By softening and reducing the static cling of a fabric, it becomes more comfortable to wear, easier to iron and generally possesses fewer hard to iron wrinkles.

It is known, as taught in U.S. Pat. No. 4,209,549, that certain hygroscopic, highly ethoxylated surfactants can be employed as anti-static agents and that such surfactants can be advantageously admixed with mixtures of glycerides and glyceride-fatty alcohol mixtures to enhance fabric softening properties. However, heretofore mixtures of such ethoxylated surfactants, glycerides and fatty alcohols have not been used commercially because of the fact such mixtures tend to suffer from poor stability at normal storage temperatures i.e. temperatures generally encountered in warehouses and other such storage facilities which generally are not provided with air conditioning to maintain controlled temperature conditions. This lack of storage stability is evidenced by a tendency of the substrate upon which the composition is carried to cling or stick to itself making it difficult to separate individual sheets of the substrate from contiguous sheets whether the sheets be stacked or in a dispensing box such as are commonly used to dispense facial tissues one at a time. In the most common means of marketing dryer sheets, the individual sheets are detachably attached to one another and are in a roll. Lack of storage stability makes it difficult to unravel a sheet from the roll because of the sticking together of the successive windings of the roll. Moreover, lack of storage stability results in dryer sheets having an uneven distribution of softening composition, reducing their effectiveness.

SUMMARY OF THE INVENTION

It is therefore an object of the present invention to provide an improved softening/anti-static composition which, when carried on a suitable substrate, can be used in a standard automatic clothes dryer.

Another object of the present invention is to provide an article of manufacture having a softening/anti-static composition which exhibits good storage stability at commonly encountered storage temperatures.

The above and other objects of the present invention will become apparent from the description given herein and the claims.

The anti-static/softening compositions of the present invention comprise an ethoxylated alcohol (surfactant) having the formula $$R—O(C_2H_4O)_x—H$$

wherein R is an aliphatic group containing from about 16 to about 30 carbon atoms, x is an integer of at least about 20 and wherein at least about 80 percent by weight of the ethoxylated alcohol is comprised of ethoxy groups ($C_2H_4O$), a fatty alcohol of the formula $$R^1—OH$$

wherein $R^1$ is an alkyl group containing from about 16 to about 30 carbon atoms, the weight ratio of the ethoxylated surfactant to the fatty alcohol being from about 1 to 3 to about 3 to 1, and from about 2 to about 10 percent by weight of the mixture of ethoxylated alcohol (surfactant) and fatty alcohol of a stabilizer which is a particulate solid and prevents any substantial release at a temperature of up to about 45° C. of the surfactant-/fatty alcohol mixture from a substrate which carries the compositions.

In another embodiment, the present invention comprises an article of manufacture comprising the softening composition described above releasibly carried on a flexible substrate.

DESCRIPTION OF THE PREFERRED EMBODIMENTS

The terms "anti-static composition", "softening composition" and "fabric treating composition" are used interchangeably herein to refer to the compositions of the present invention comprising three main ingredients of (a) an ethoxylated alcohol (surfactant), (b) a fatty alcohol and (c) a storage stabilizer which is preferably a clay, a carbohydrate polymer or a mixture thereof.

The ethoxylated alcohols which are useful as anti-static agents in the compositions and articles of the present invention have the general formula $$R—O(C_2H_4O)_x—H$$

wherein R is an alkyl group, preferably linear, containing from about 16 to about 30 carbon atoms and x is an integer of at least about 20, preferably 20 to about 100, most preferably from about 20 to 50. The value of x should be such that the weight of the ethoxy groups ($C_2H_4O$) constitutes at least 80 percent by weight of the ethoxylated alcohol, preferably from about 85 to 90 percent by weight of the ethoxylated alcohol.

Specific, non-limiting examples of such hygroscopic surfactants include ethoxylates of hexadeca-, eicosa-, hexacosa-, etc. alcohols condensed with at least 20 moles of ethylene oxide. Commercially useful ethoxylated surfactants are the higher ethoxylates of mixed natural or synthetic alcohols such as for example ethoxylated alcohol sold under the names ALFONIC or NOVEL by Vista Chemical Company.

The fatty alcohols useful in the softening compositions and articles of the present invention are those alcohols having the formula:

$$R^1—OH$$

wherein R is an alkyl group containing from about 16 to about 30 carbon atoms, more preferably from about 16 to about 20 carbon atoms.

Suitable examples of non-limiting, fatty alcohols include hexadecanol, eicosanol, hexacosanol, etc. The fatty alcohols can be synthetic or natural in nature and mixtures of fatty alcohols such as those obtained in the Oxo process can be employed. Long chain, i.e. fatty alcohols, sold under the name ALFOL by Vista Chemical Company are ideally suited for use in the compositions of the present invention. The fatty alcohol can comprise a single, pure fatty alcohol or a mixture of alcohols having the desired chain length. Especially preferred are fatty alcohols having a carbon chain length from about 16 to about 20 carbon atoms.

The surfactant and fatty alcohol will be present in the fabric-treating compositions in a weight ratio of from about 3 to 1 to about 1 to 3, a weight ratio of about 1 to 1 being preferred.

The final, necessary component of the softening compositions of the present invention is a stabilizer. Basically, the stabilizer can be any compound or a mixture of compounds which when admixed with the fatty alcohol and surfactant does not interfere with the softening-/anti-static properties imparted by those components, has a melting point of greater than about 75° C., is or can, be formed into a finely divided, particulate solid e.g. a powder, which can be intimately mixed with the fatty alcohol/surfactant to provide a generally homogeneous mixture, will prevent any substantial release of the mixture of fatty alcohol and/or surfactant from the substrate upon which the softening composition is carried at temperatures up to about 45° C. and is insoluble in the fatty alcohol/surfactant mixtures. Non-limiting examples of such stabilizers include clays and carbohydrate polymers.

The term clays as used herein is intended to mean naturally occurring, inorganic substances which generally, but not always, are composed of hydrous aluminum silicates. For example, as used herein, the term clay is intended to include minerals such as talc, a natural hydrous magnesium silicate. More specifically, clay is intended to include naturally occurring materials which exist or can be formed into particles of very fine size having the essential composition of crystalline fragments of minerals that are essentially hydrous aluminum silicates or occasionally hydrous magnesium silicates. Non-limiting examples of suitable clays include kaolinites, montmorillonites, attapulgites, illites (hydro mica) etc.

The carbohydrate polymers which are useful as stabilizers in the compositions and articles of the present invention, generally speaking, are polysaccharides such as starch and cellulose as well as naturally occurring gums which are generally composed of monosaccharide units joined by glycosidic bonds. Non-limiting examples of such gums are guar gum, arabic gum, agar, etc. Also included are polymeric materials such as hydroxyethylcellulose, carboxymethylcellulose and other hydroxyalkylcellulosic polymeric materials. Because they are inexpensive and readily accessible, starches make ideal stabilizers. Thus, starches such as corn starch, arrowroot starch, potato starch, amioca, sago, etc. can be employed.

The stabilizer will be present in the compositions of the present invention in an amount of from about 2 to about 10, especially from about 4 to about 7 percent, by weight of the combined weight of the ethoxylated alcohol (surfactant) and fatty alcohol.

The articles of manufacture of the present invention comprise the softening compositions comprised of the surfactant, the fatty alcohol and the stabilizer, in intimate mixture, carried e.g. coated on or impregnated in a suitable flexible substrate. Such a substrate serves to evenly distribute the composition onto the fabrics under the heating and tumbling action of an automatic clothes dryer. One such substrate that can be employed comprises a sponge material releasibly carrying enough of the composition to effectively impart antistatic/softening properties to fabrics during several cycles of clothes drying.

Another suitable substrate comprises a cloth or paper bag releasibly enclosing the composition and sealed with a hardened plug of the composition which, upon heating, opens the bag and releases the fabric treating composition therein.

Especially preferred as the substrate for use in the article of manufacture of the present invention is a flexible paper or woven or non-woven cloth substrate carrying the softening composition such that the reaction of the automatic dryer releases the fabric treating composition from the substrate and deposits it on the fabrics. Such flexible sheet substrates are most conveniently provided in the form of sheets, generally 9" by 11", which can be individually dispensed from a container or, more suitably, detachably secured to one another on a roll whereby as the windings of the roll are uncoiled, individual sheets can be torn off, generally along perforations, so that the sheets can be used as desired.

The softening compositions can be easily affixed to the sheet substrates by simple dipping or padding processes or by other processes well known to those skilled in the art. The preferred sheet substrates can have a dense, or more preferably, open or porous structure. Examples of suitable materials for making the sheet substrates include paper, woven cloth and non-woven cloth e.g. a spun bond polyester. The term "cloth" as used herein, means a woven or non-woven substrate for the articles of manufacture, as distinguished from the term "fabric" which encompasses the clothing fabrics being dried in an automatic dryer. Suitable materials for making the substrate sheets are fully disclosed in U.S. Pat. No. 3,632,396, incorporated herein by reference.

In general, when the preferred sheet substrates are employed, they will be coated or otherwise impregnated with sufficient softening composition to effectively soften and prevent static in a typical load of clothes i.e. about 5–6 pounds dry weight. Typically, a substrate sheet of 9 by 11 inches will contain from about 1 to about 4 grams of the softening composition of the present invention.

The compositions and articles of the present invention can contain various optional ingredients such as perfumes, brighteners, fumigants, bactericides, fungicides, flame retardants, soil release agents, and the like, all of which are commonly used in commercially available fabric softeners. Specific examples of typical additives useful herein can be found in any current *Yearbook of the American Association of Textile Chemists and Colorists.*

In use, the articles of manufacture of the present invention e.g. the substrate sheets containing the softening compositions, are introduced, together with damp fabrics generally containing from about 1 to about 1.5 times their weight of water in the drum of an automatic clothes dryer. The dryer is then operated in the standard fashion to dry the fabrics, usually at a temperature from about 50° C. to about 80° C., for time periods ranging from 10 minutes to about 60 minutes depending on the fabric load and type. The sheet substrate or other type of substrate generally carries an amount of the softening composition so as to dispense the composition into the fabrics as a rate of from about 1 gram to about 10 grams, preferably about 2–3 grams per five pounds of fabric.

To more fully illustrate the present invention, the following non-limiting examples are presented.

EXAMPLE 1

Various formulations of softening compositions were prepared by intimately admixing a suitable fatty alcohol, a suitable ethoxylated alcohol surfactant and a suitable stabilizer. In addition, for comparative purposes a formulation containing no stabilizer was also prepared. In preparing the softening compositions, the fatty alcohol and the ethoxylated surfactant were intimately admixed, using heat if necessary, to obtain a homogeneous mixture after which the stabilizer was stirred in until an intimate substantially homogenous mixture was obtained. The formulation data for the various softening compositions is given in Table 1 below.

TABLE 1

| | Fatty Alcohol | Ethoxylated Alcohol | Stabilizer (Wt %) | Melting[d] Range |
|---|---|---|---|---|
| Composition A | ALFOL 1618CG[a] (47.5) | ALFONIC 1618-87[b] (47.5) | Corn Starch (5.0) | 49–56° C. |
| Composition B | ALFOL 1618CG (47.5) | ALFONIC 1618-87 (47.5) | Clay[c] (5.0) | 49–56° C. |
| Composition C | ALFOL 1618CG (50.0) | ALFONIC 1618-87 (50.0) | | 49–53° C. |

[a]Mixture of approximately 30% $C_{16}$ and 70% $C_{18}$ linear alcohols marketed by Vista Chemical Company.
[b]Ethoxylated alcohol (30% $C_{16}$, 70% $C_{18}$) containing approximately 87% by weight ethylene oxide marketed by Vista Chemical Company.
[c]Kaolin.
[d]Melting range necessary for a dryer sheet is about 40° C. to 60° C.

EXAMPLE 2

Dryer sheets were prepared using 9×11 inch swatches of a spun bond polyester cloth marketed by Reemay. Various softening compositions of Example 1 were melted in an oven and then poured into a small stainless steel pan heated on a hotplate. The swatches of the polyester cloth were weighed following which the cloth was immersed in the melted softening composition and removed with tongs. The treated swatches were allowed to dry and weighed. Since the desired goal was to deposit 1.5 to 2.0 grams of softening composition on each swatch, if excess softening composition was present the sheet was placed on a heated flat surface and softening composition removed by wiping with a plastic blade. The cloths were then hung to dry and reweighed. This procedure was repeated until the softening composition on the cloth was evenly distributed and ranged from about 1.5 to about 2.0 grams per dryer sheet. In all cases, an attempt was made to ensure that the test dryer sheets contained substantially the same amount of softening composition as any commercially available dryer sheets against which testing was made.

EXAMPLE 3

To demonstrate the anti-static capabilities of the compositions of the present invention, the dryer sheets prepared as per Example 2 were employed and compared with two commercially available dryer sheets (9"×11"), Snuggle® sold by Lever and Bounce® sold by Proctor and Gamble. In each test, a bundle of clothes weighing 6.25 pounds and made up of the following items: 2 twin sheets (50/50 polyester/cotton), one full length nylon nightgown, one nylon half slip, two pair nylon underwear, six pair polyester socks, and five cotton towels, was washed with a commercially available detergent twice in hot water. The test bundle was then transferred to the dryer which had been previously treated to ensure removal of any prior added anti-static/softener and a pre-weighed dryer sheet was added. The test bundle plus dryer sheet (if used) was dried for 40 minutes. At the end of the drying time, the clothes were removed and the degree of static visually noted. The results are shown in Table 2 below:

TABLE 2

| | Static (Visual) |
|---|---|
| Composition A | None |
| Composition B | None |
| Snuggle | None |
| Bounce | None |
| No dry sheet | Yes |

As can be seen from the data in Table 2, the dryer sheets of the present invention show anti-static properties at least as good as those of commercially available dryer sheets.

EXAMPLE 4

Three sets of four towels each were individually labeled with randomly generated three-digit numbers in order to ensure objectivity of softness testing. To remove sizing on the fabric, each bundle of towels was washed four times in hot water using a commercially available detergent. Prior to each test the dryer was treated to remove any residual anti-static/softener from prior use. The washed bundle was added to the dryer together with a dryer sheet and the towels dried for 40 minutes. To determine softness of the dried towels, sixty subjects were asked to compare quality. The results are shown in Table 3 below.

TABLE 3

| | Snuggle | Composition A | Composition B |
|---|---|---|---|
| Softness[a] Preference | 6.6 ± 1.3 | 6.2 ± 1.7 | 6.4 ± 1.5 |

[a]9 = Extreme softness
5 = Low softness
1 = Rough

As can be seen from the data in Table 3, the dryer sheets using the compositions of the present invention have a softness comparable to that achieved with a commercially available dryer sheet.

EXAMPLE 5

This example demonstrates interval release of the softening compositions of the present invention in a standard clothes drying cycle. In this example, the test bundle of clothes of Example 3 was used. Each bundle was put through a standard wash cycle which included three preparatory washes and one final wash. Each wash cycle was 12 minutes employing 40 grams of a commercially available detergent in 120° F. water. A standard fabric softener sheet (9×11 inches) was weighed to the nearest 0.001 grams. The weight was recorded. Each dryer sheet had approximately 1.8 grams of softening/anti-static composition. A test bundle of clothes was placed in the preheated dryer along with a preweighed fabric dryer sheet. Clothes were dried for five minutes using the minute clock timer. After five minutes, the dryer door was opened, the fabric softener sheet removed and weighed, the weight being recorded. The softener sheet was placed back into the dryer and the bundle dried for an additional five minutes after which the sheet was again weighed and the weight recorded. This five-minute interval drying of the standard bundle with the fabric softener sheet was repeated until 40 minutes of drying time had accumulated. At the end of the 40-minute release period, the amount of softener that was released every five minutes was added together to obtain the total amount of release. The results are shown in Table 4 below.

TABLE 4

| MIN | Snuggle (grams) | Composition A[a] (Grams) | Composition B[a] (Grams) | Composition C[a] (Grams) | Composition D[b] (Grams) |
|---|---|---|---|---|---|
| 5 | .120 (.001) | .696 (.344) | .507 (.023) | .432 (.166) | .667 |
| 10 | .190 (.030) | .329 (.180) | .340 (.102) | .608 (.133) | .200 |
| 15 | .111 (.032) | .150 (.010) | .245 (.050) | .181 (.009) | .143 |
| 20 | .075 (.016) | .110 (.030) | .097 (.001) | .116 (.009) | .088 |
| 25 | .099 (.024) | .073 (.021) | .068 (.009) | .065 (.004) | .102 |
| 30 | .066 (.014) | .031 (.004) | .065 (.001) | .065 (.004) | .027 |
| 35 | .033 (.018) | .046 (.016) | .056 (.002) | .049 (.015) | .031 |
| 40 | .021 (.021) | .056 (.010) | .051 (.005) | .042 (.002) | .054 |
| TOT | .713 (.041) | 1.490 (.100) | 1.427 (.085) | 1.556 (.011) | 1.312 |

[a]These values are averages of two dryer runs. The values in parentheses are the ranges for the two runs.
[b]25% by weight ALFOL 1618CG, 25% by weight ALFONIC 1618-87, 50% by weight of tallow glyceride with a ratio of 20:6:1 of mono:di:triglycerides; Melting point range of 50°-57° C.

As can be seen from the data in Table 4, the softening compositions of the present invention show excellent and uniform release over the drying period. Note that the compositions of the present invention release virtually twice as much as the commercially available dryer sheet Snuggle and approximately 15 percent more than a blend of ethoxylated alcohol surfactant, fatty alcohol and glyceride disclosed in U.S. Pat. No. 4,209,549.

EXAMPLE 5

This example demonstrates the importance of the storage stabilizer in the compositions of the present invention. Dryer sheets were prepared in accordance with Example 2. In each test, at least two sheets were superimposed upon one another in an oven. The sheets remained at progressive temperatures in the oven for two days. At each interval, the sheets were removed from the oven and allowed to cool. If the sheets were glued together i.e. could not be separated, it was considered that they had failed the storage test. Failure was also indicated by a visually noticeable uneven distribution of softening composition on the dryer sheet. The data is shown below in Table 5 for various compositions including two commercially available compositions at three different temperature ranges.

TABLE 5

| | 120 Degrees F. | 130 Degrees F. | 140 Degrees F. |
|---|---|---|---|
| Bounce | PASS | PASS | FAIL |
| Snuggle | PASS | PASS | FAIL |
| Composition A | PASS | PASS | BORDERLINE |
| Composition B | PASS | PASS | BORDERLINE |

As can be seen from the data in Table 5, dryer sheets using the compositions of the present invention preform much better than two commercially available dryer sheets in that at 140° F., there was complete failure of the commercially available dryer sheets while the dryer sheets using the softening compositions of the present invention were considered to be borderline. This is important since it is not uncommon for dryer sheets to be stored in warehouses and other such storage facilities where temperatures can reach 45° C., i.e. approximately 115° F. The use of the stabilizer prevents release of the softening compositions up to these temperatures thereby ensuring that the dryer sheets will not lose their effectiveness.

The foregoing description of the invention has been directed in primary part to a particular preferred embodiment in accord with the requirements of the patent statutes and for purposes of explanation and illustration.

However, it is Applicant's intention in the following claims to cover all modifications and variations as fall within the true spirit and scope of the invention.

What is claimed is:

1. An article of manufacture adapted for use in an automatic clothes dryer comprising:

(a) a fabric treating composition comprising (i) a surfactant having the formula $$R—O(C_2H_4O)_x—H$$

wherein R is an aliphatic group containing from about 16 to about 30 carbon atoms and x is an integer of at least about 20;

(ii) a fatty alcohol containing from about 16 to about 30 carbon atoms;

the weight ratio of said surfactant to said alcohol being from about 3 to 1 to about 1 to 3, the value of x being such that the groups ($C_2H_4O$) constitute at least about 80% by weight of said surfactant, and (iii) from about 2 to about 10 percent by weight of the mixture of said surfactant and said fatty alcohol of a storage stabilizer, (b) a flexible substrate in releasable combination with said fabric treating composition said stabilizer being a particulate solid which prevents any substantial release of said composition from said substrate at temperatures up to about 45° C.; said stabilizer being selected from the group consisting of clays, carbohydrate polymers and mixtures thereof.

2. An article according to claim 1 wherein the ratio of said surfactant to said fatty alcohol is about 1 to 1.

3. An article according to claim 1 wherein said stabilizer is present in an amount of from about 4 to about 7 percent by weight of the combined weight of said surfactant and said fatty alcohol.

4. An article according to claim 1 wherein x is from about 20 to about 50.

5. An article according to claim 1 wherein R is an alkyl group containing from about 16 to about 20 carbon atoms.

6. An article according to claim 1 wherein said fatty alcohol contains from about 16 to about 20 carbon atoms.

7. An article according to claim 1 wherein said carbohydrate polymer comprises a starch.

8. An article according to Claim 1 wherein the value of x is such that the groups ($C_2H_4O$) constitute from about 85 to about 90% by weight of said surfactant.

* * * * *